US010657944B2

(12) United States Patent
Steinhauser

(10) Patent No.: US 10,657,944 B2
(45) Date of Patent: May 19, 2020

(54) ELECTRONIC CYMBAL ASSEMBLY AND COMPONENTS THEREOF

(71) Applicant: GEWA music GmbH, Adorf (DE)

(72) Inventor: Ruben Steinhauser, Altusried (DE)

(73) Assignee: GEWA music GmbH, Adorf (DE)

( * ) Notice: Subject to any disclaimer, the term of this patent is extended or adjusted under 35 U.S.C. 154(b) by 0 days.

(21) Appl. No.: 15/872,899

(22) Filed: Jan. 16, 2018

(65) Prior Publication Data

US 2018/0204557 A1 Jul. 19, 2018

Related U.S. Application Data

(60) Provisional application No. 62/447,297, filed on Jan. 17, 2017.

(51) Int. Cl.

| | |
|---|---|
| ***G10H 3/14*** | (2006.01) |
| ***G10D 13/02*** | (2020.01) |
| ***G10D 13/06*** | (2020.01) |

(52) U.S. Cl.

CPC ..... *G10H 3/146* (2013.01); *G10D 13/024* (2013.01); *G10D 13/06* (2013.01); *G10H 2220/461* (2013.01); *G10H 2220/525* (2013.01); *G10H 2230/321* (2013.01)

(58) Field of Classification Search

CPC ..... G10H 3/146; G10H 2220/461; G10H 2220/525; G10H 2230/321; G10D 13/024; G10D 13/06

See application file for complete search history.

(56) References Cited

U.S. PATENT DOCUMENTS

| | | | | |
|---|---|---|---|---|
| 4,242,937 | A | 1/1981 | Pozar | |
| 6,881,885 | B2 | 4/2005 | Donels | |
| 7,385,135 | B2 | 6/2008 | Yoshino | |
| 8,563,843 | B1 | 10/2013 | Shemesh | |
| 9,424,827 | B2 | 8/2016 | Gill | |
| 9,721,549 | B2 | 8/2017 | Sikra | |
| 2002/0112593 | A1* | 8/2002 | Yanase ..... | G10D 13/024 84/411 P |
| 2004/0118269 | A1 | 6/2004 | Yoshino | |
| 2005/0150366 | A1 | 7/2005 | Sasami | |
| 2006/0156910 | A1 | 7/2006 | Yoshino | |
| 2007/0234886 | A1 | 10/2007 | Matsuyuki | |
| 2013/0047826 | A1 | 2/2013 | Wissmuller | |
| 2013/0180388 | A1 | 7/2013 | Mori | |

(Continued)

OTHER PUBLICATIONS

Office Action for U.S. Appl. No. 15/847,557; dated Sep. 12, 2018.

(Continued)

*Primary Examiner* — Kimberly R Lockett

(74) *Attorney, Agent, or Firm* — Posz Law Group, PLC

(57) ABSTRACT

Electronic cymbal assemblies are disclosed. Assemblies according to the disclosure can include a single frame and a cover thereon, the cover including a cutout with flat edges to prevent accidental rotation of cymbal assembly components. Assemblies according to the present disclosure can also include non-planar sensors that can be applied to the bell and edge portions of a frame, sensors and frames with respective protrusions and bumps to mate with one another, and cover undersides with non-smooth surfaces to increase sensitivity to user actuation.

28 Claims, 6 Drawing Sheets

(56) References Cited

U.S. PATENT DOCUMENTS

| | | | | |
|---|---|---|---|---|
| 2015/0027301 | A1 | 1/2015 | Shih | |
| 2015/0294658 | A1 | 10/2015 | Gill | |
| 2016/0196811 | A1 | 7/2016 | Shen | |
| 2016/0203804 | A1 * | 7/2016 | Carpenter, Sr. ..... | G10D 13/06 84/422.3 |
| 2016/0210943 | A1 | 7/2016 | Sikra | |
| 2018/0174556 | A1 | 6/2018 | Steinhauser | |

OTHER PUBLICATIONS

International Search Report for Application No. PCT/US2017/067605; dated Feb. 26, 2018.
International Search Report for Application No. PCT/US2018/13917; dated May 15, 2018.

* cited by examiner

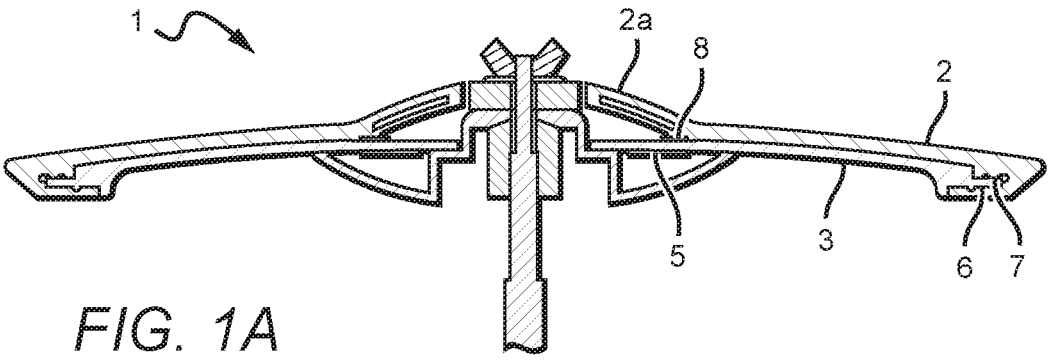
FIG. 1A
PRIOR ART
FIG. 1B
PRIOR ART
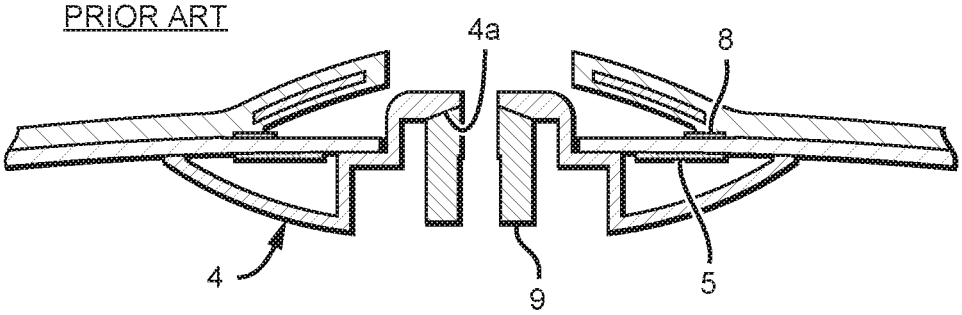
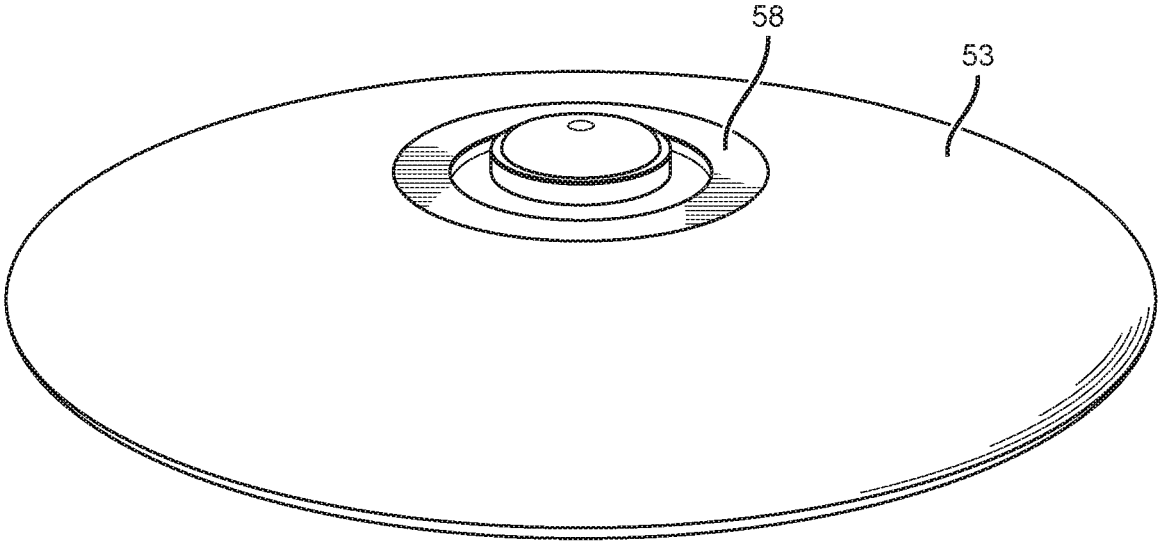
FIG. 2
PRIOR ART

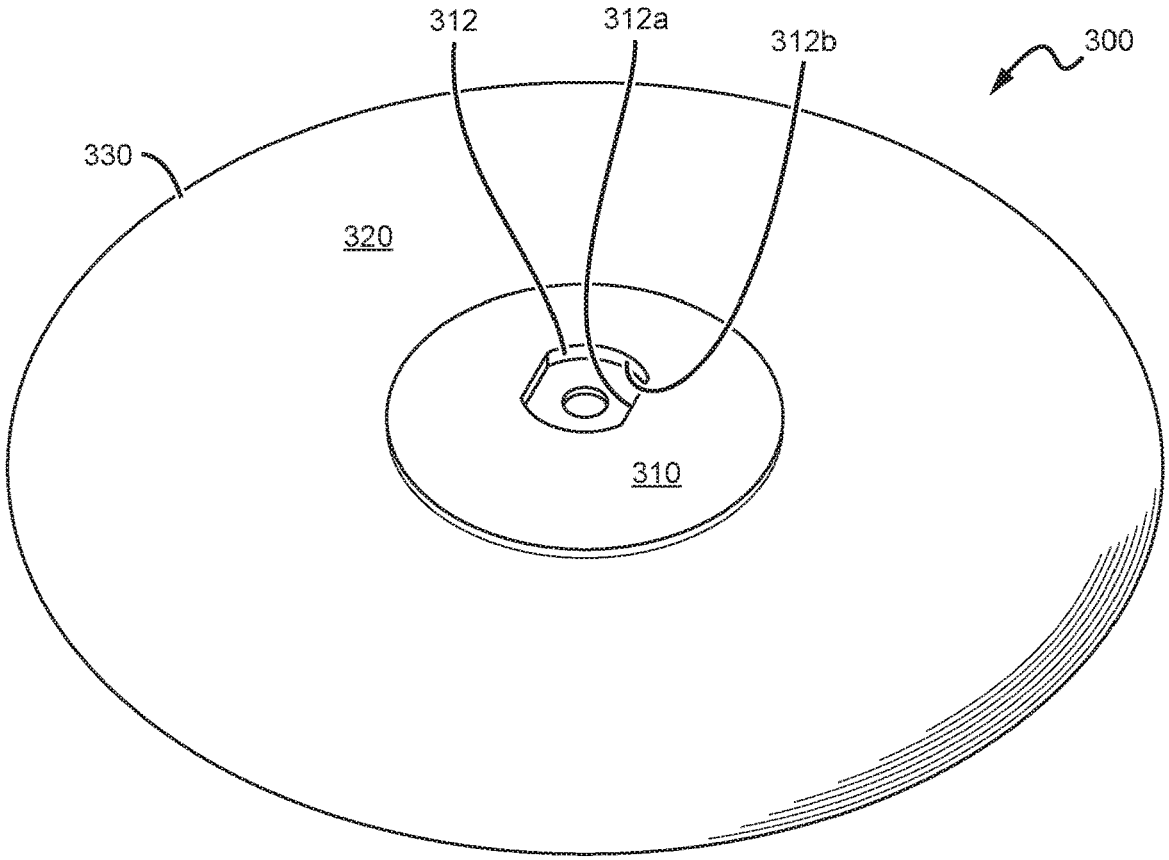
FIG. 3A
FIG. 3B
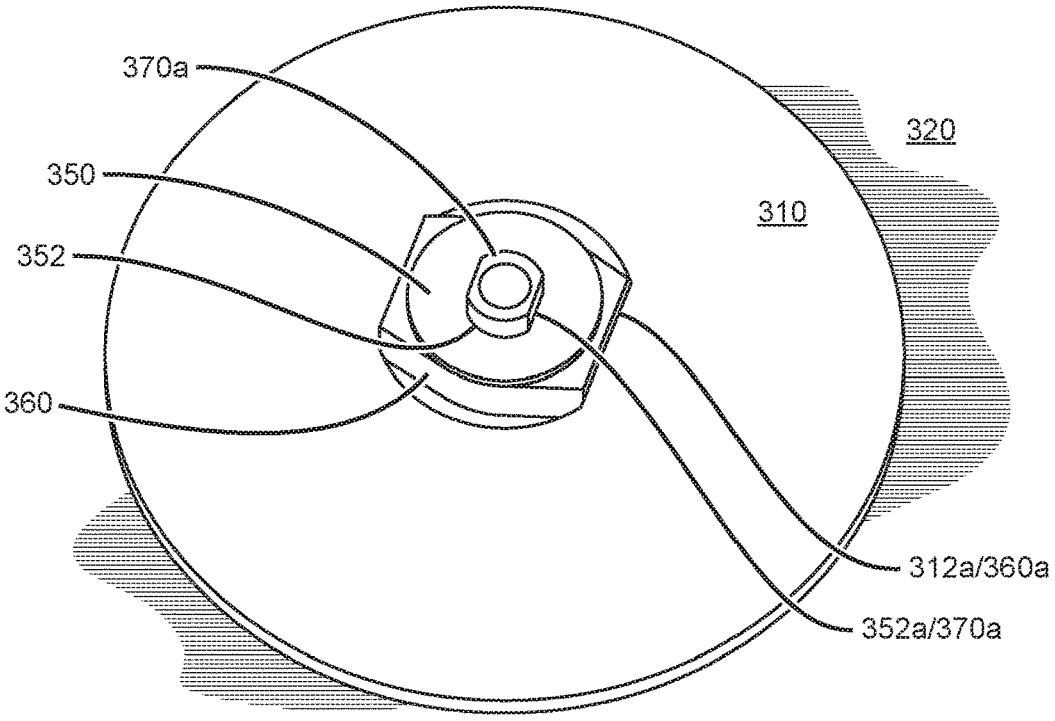

FIG. 8
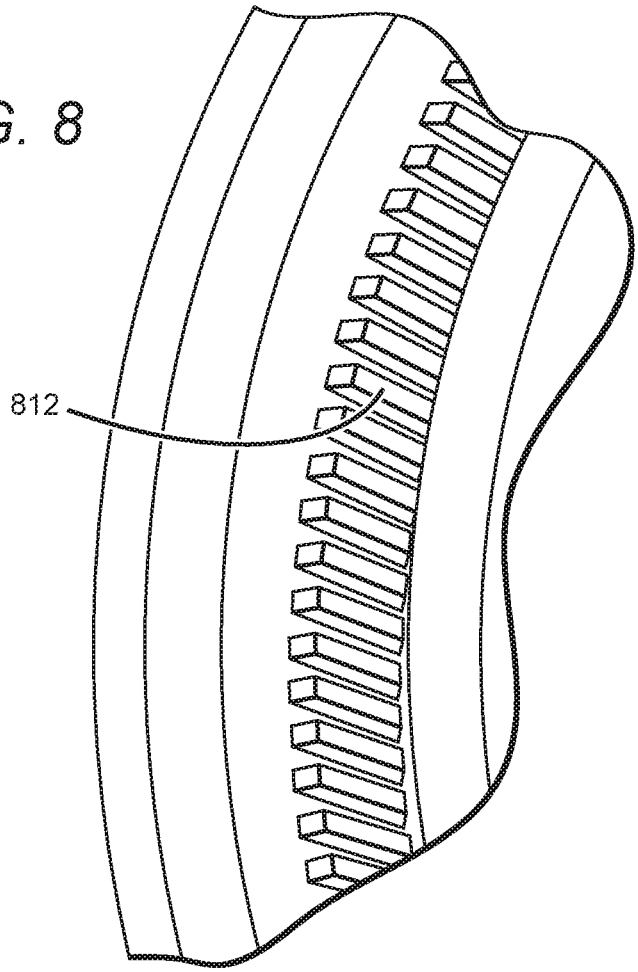
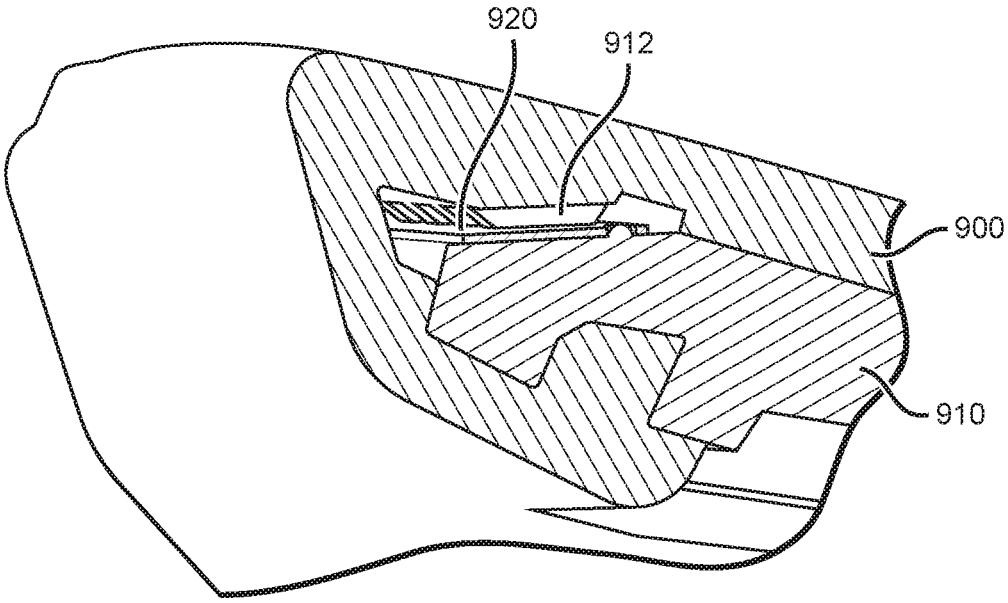
FIG. 9

ELECTRONIC CYMBAL ASSEMBLY AND COMPONENTS THEREOF

This application claims the priority of U.S. Provisional Pat. App. No. 62/447,297 to Steinhauser, entitled "Electronic Cymbal Assembly and Components Thereof" and filed on Jan. 17, 2017, which is fully incorporated by reference herein in its entirety.

BACKGROUND OF THE DISCLOSURE

Field of the Disclosure

This disclosure relates generally to devices for use with cymbals, assemblies including cymbals, and components of assemblies including cymbals, and especially electronic cymbals.

Description of the Related Art

Cymbals are common percussion instruments most often consisting of thin, round plates having a curve across their diameter. Typically, a cymbal's cross-section has one curve from its outside edge toward its center (referred to as the cymbal's "bow"), followed by a second curve with a more pronounced rise in the center (referred to as the cymbal's "bell"). The bell often includes a hole therethrough for accommodating a holder, either as part of a cymbal stand or as a separate element that is connected to a cymbal stand. A percussionist plays a cymbal, often made of metal, by striking it, often with a drum stick. Due to its composition and shape, when struck a cymbal most often produces a "crash" sound. In one arrangement, two cymbals are included in a hi-hat, with the concave sides of each of the cymbals facing one another. A percussionist, often via a foot pedal, causes one or both of the cymbals to move toward and strike one another, resulting in a second type of crash sound.

Electronic musical instruments such as electronic cymbals are designed to produce a synthetic sound. Often, an electronic cymbal is shaped like a traditional cymbal and uses electronic componentry to detect a percussionist's strike and produce a sound similar to the sound a traditional acoustic cymbal would make under similar circumstances. Electronic cymbals are most often made of non-metallic materials, such as rubber.

U.S. Pat. No. 6,881,885 to Roland Corporation, which is fully incorporated by reference herein in its entirety, describes prior art electronic cymbal assemblies. FIGS. 1A and 1B show a cross-sectional view of one such prior art assembly 1. The cymbal assembly 1 includes a first frame 3, a second frame 4, and a cover 2 on the first frame 3. The cymbal assembly 1 also includes a rotation stop member 9. The concave portion 4*a* of the second frame and the rotation stop member 9 combine to prevent unintended rotation of the assembly 1, thus increasing the probability that a user actuates an appropriate portion of the assembly 1, which is important since the sensors of the assembly 1 may not be arranged to detect actuations in all portions of the assembly. The relationships of the elements shown in FIGS. 1A and 1B, such as that of the second frame 4 and the rotation stop member 9, are described more fully in U.S. Pat. No. 6,881,885.

The assembly 1 includes a piezoelectric sensor 5 for detecting an actuation upon the cover 2, and in some instances also detecting the strength or force of that actuation. A sheet sensor 8 proximate the bell of the cover, and sheet sensors 6, 7 proximate the edge of the cover, can be utilized to determine the location of an actuation. The term "edge" as used herein when referring to the outermost parts of frames and covers refers to the outermost portion of the top surface of that part, as opposed to a side surface of that part.

As can be seen, the first frame 3 does not include a well-defined bell or raised portion in its center; the bell 2*a* is defined solely by the cover 2. The flat sheet sensor 8 is placed on the first frame 3 in an area where it can detect actuation of the bell 2*a* of the cover 2, such as under an outside edge of the bell 2*a* as shown. The lack of a bell in the first frame 3 is necessary in prior art devices so that the flat sheet sensor 8 can be easily placed to adequately detect actuation in the bell area of the cover 2.

FIG. 2 is a perspective view of another prior art cymbal component. FIG. 2 shows a frame 53, which is similar to or the same as the first frame 3. FIG. 2 also shows a planar sensor sheet 58, which is similar to or the same as the planar sensor sheet 8 shown in FIG. 1. As can be seen, the frame 53 does not include a raised "bell" area as would be typical in a traditional acoustic cymbal.

SUMMARY OF THE DISCLOSURE

One embodiment of an electronic cymbal assembly according to the present disclosure includes a cover with a noncircular cutout. The cutout can in some embodiments be in the center of the cover and/or include two flat edges.

Another embodiment of an electronic cymbal assembly according to the present disclosure includes a frame shaped to define a bell, and a non-planar sensor on the frame bell. The sensor includes first and second portions distinct from one another, with the sensor defining a substantially annular shape.

Yet another embodiment of an electronic cymbal assembly according to the present disclosure includes a cymbal frame and a cover on the cymbal frame. A sensor is between the cymbal frame and the cover, with a topside of the sensor in contact with an underside of the cover. At least one of the topside of the sensor and the underside of the cover includes a non-smooth surface.

Yet another embodiment of an electronic cymbal assembly according to the present disclosure includes a frame and a sensor, with one of the frame and the sensor including protrusions and the other shaped to define holes mating with the protrusions.

This has outlined, rather broadly, the features and technical advantages of the present disclosure in order that the detailed description that follows may be better understood. Additional features and advantages of the disclosure will be described below. It should be appreciated by those skilled in the art that this disclosure may be readily utilized as a basis for modifying or designing other structures for carrying out the same purposes of the present disclosure. It should also be realized by those skilled in the art that such equivalent constructions do not depart from the teachings of the disclosure as set forth in the appended claims. The novel features, which are believed to be characteristic of the disclosure, both as to its organization and method of operation, together with further features and advantages, will be better understood from the following description when considered in connection with the accompanying figures. It is to be expressly understood, however, that each of the figures is provided for the purpose of illustration and description only and is not intended as a definition of the limits of the present disclosure.

BRIEF DESCRIPTION OF THE DRAWINGS

FIGS. 1A and 1B show cross-sectional views of parts of a prior art electronic cymbal assembly;

FIG. 2 shows a perspective view of part of a prior art electronic cymbal assembly;

FIGS. 3A and 3B show top perspective and magnified top perspective views of portions of one embodiment of a cymbal assembly according to the present disclosure;

FIG. 8 shows a bottom perspective view of a portion of a cover according to one embodiment of the present disclosure; and FIG. 9 shows a cross-sectional view of a portion of a cymbal assembly according to one embodiment of the present disclosure.

DETAILED DESCRIPTION OF THE DISCLOSURE

Figure 4A:
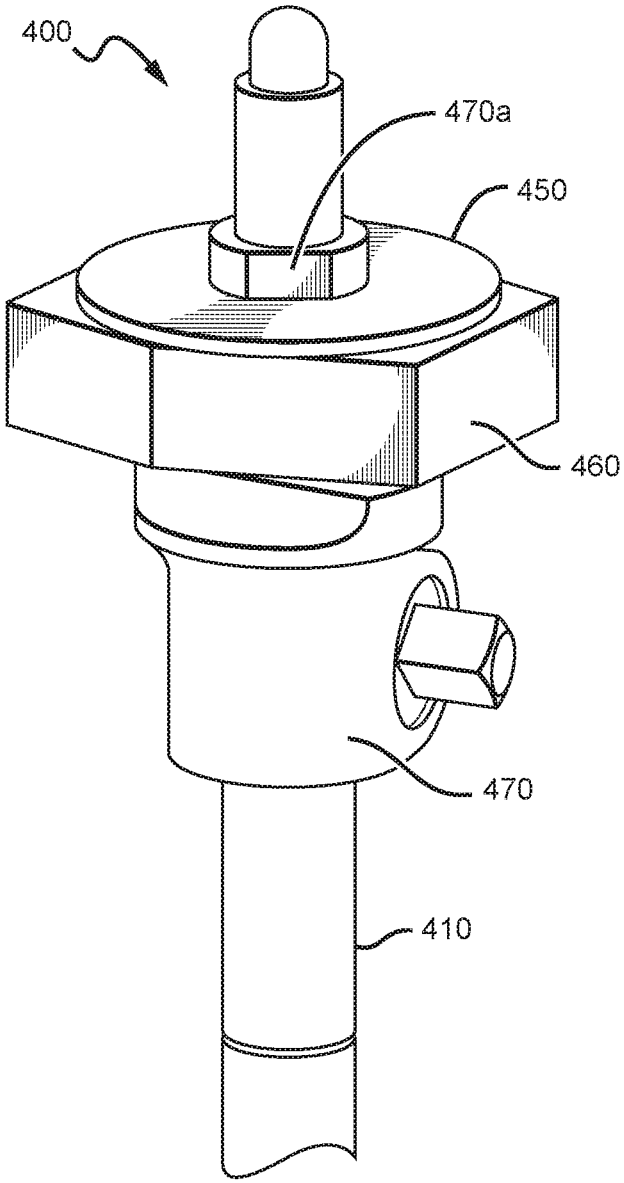
FIGS. 4A and 4B show side perspective and exploded perspective views of portions of one embodiment of a cymbal assembly according to the present disclosure.

Electronic cymbal assemblies are disclosed. Assemblies according to the disclosure can include a single frame and a cover thereon, the cover including a cutout with flat edges to prevent accidental rotation of cymbal assembly components. Assemblies according to the present disclosure can also include non-planar sensors that can be applied to the bell and edge portions of a frame, sensors and frames with respective protrusions and bumps to mate with one another, and cover undersides with non-smooth surfaces to increase sensitivity to user actuation.

It is understood that when an element is referred to as being "on" another element, it can be directly on the other element or intervening elements may also be present. Further, when one element is referred to as being "connected" to another element, it can be directly connected to the other element or intervening elements may also be present as would be understood by one of skill in the art. Furthermore, relative terms such as "inner", "outer", "upper", "top", "above", "lower", "bottom", "beneath", "below", and similar terms, may be used herein to describe a relationship of one element to another. Terms such as "higher", "lower", "wider", "narrower", and similar terms, may be used herein to describe angular and/or relative relationships. It is understood that these terms are intended to encompass different orientations of the elements or system in addition to the orientation depicted in the figures.

Although the terms first, second, etc., may be used herein to describe various elements, components, regions and/or sections, these elements, components, regions, and/or sections should not be limited by these terms. These terms are only used to distinguish one element, component, region, or section from another. Thus, unless expressly stated otherwise, a first element, component, region, or section discussed below could be termed a second element, component, region, or section without departing from the teachings of the present disclosure.

Embodiments of the disclosure are described herein with reference to view illustrations that are schematic illustrations. As such, the actual thickness of elements can be different, and variations from the shapes of the illustrations as a result, for example, of manufacturing techniques and/or tolerances are expected. Thus, the elements illustrated in the figures are schematic in nature and their shapes are not intended to illustrate the precise shape of a region and are not intended to limit the scope of the disclosure.

Embodiments of cymbal assemblies according to the present disclosure can include a cover designed for rotation inhibition so as to raise the chances that a user strikes a portion of the assembly sensitive to actuation. In such assemblies, use of the combination of a second frame and rotation stop member, such as the second frame 4 and rotation stop member 9 from FIG. 1, is not necessary, and the second frame can be eliminated from the assembly, thus reducing material, cost, weight, and complexity, among other advantages. One example of a cover 300 according to the present disclosure is shown in FIGS. 3A and 3B. The cover 300 can include a cover bell portion 310, a cover bow portion 320, and a cover edge 330, although it is understood that the cover bell portion can be omitted and the attributes thereof can instead be included in the cover bow portion of a cover not including a bell portion. The cover edge 330 can be part of the cover bow portion 320, and the cover bell portion, bow portion, and edge can all be integral with one another and made of a single piece. The cover bell portion 310 can include a cutout 312. In this specific embodiment the cutout 312 includes two flat edges 312*a* and two curved edges 312*b*, although other shapes are possible, including but not limited to regular and irregular polygon shapes, combinations of flat and curved edges, shapes with one or more flat edges, shapes with two or more flat edges, shapes with circular edges, shapes with oval-shaped edges, star shapes, etc.

As shown in FIG. 3B, the cover 300 can be utilized in combination with a washer 350, stopper 360, and cymbal carrier 370 (only the portion 370*a* of which is shown in FIG. 3B). The stopper 360 can be made of and/or comprise, for example, foam such as cell foam. The stopper 360 can be rigid or pliable. The stopper 360 can be designed to include a shape matching or at least partially matching that of the cutout 312; in this case, the stopper 360 includes two flat edges 360*a* matching the flat edges 312*a* of the cutout 312. Similarly, the washer 350 and/or cover 360 can include a cutout 352 through which a portion 370*a* of the cymbal carrier 370 can protrude. The washer cutout 352 can match or at least partially match the shape of the portion 370*a* of the cymbal carrier 370. For instance, the washer cutout 352 can include flat edges 352*a* which can match flat edges of the cymbal carrier portion 370*a*, although other shapes such as shapes that match one another are possible, such as zig-zags, angular shapes, etc., and non-matching shapes between the different cutouts are possible. The inclusion of non-circular shapes, such as those described above including one or more flat edges, and particularly two or more flat edges, can aid in preventing unintended rotation of portions of the assembly such as the cover 300, resulting in the previously-described benefits.

Figure 4B:
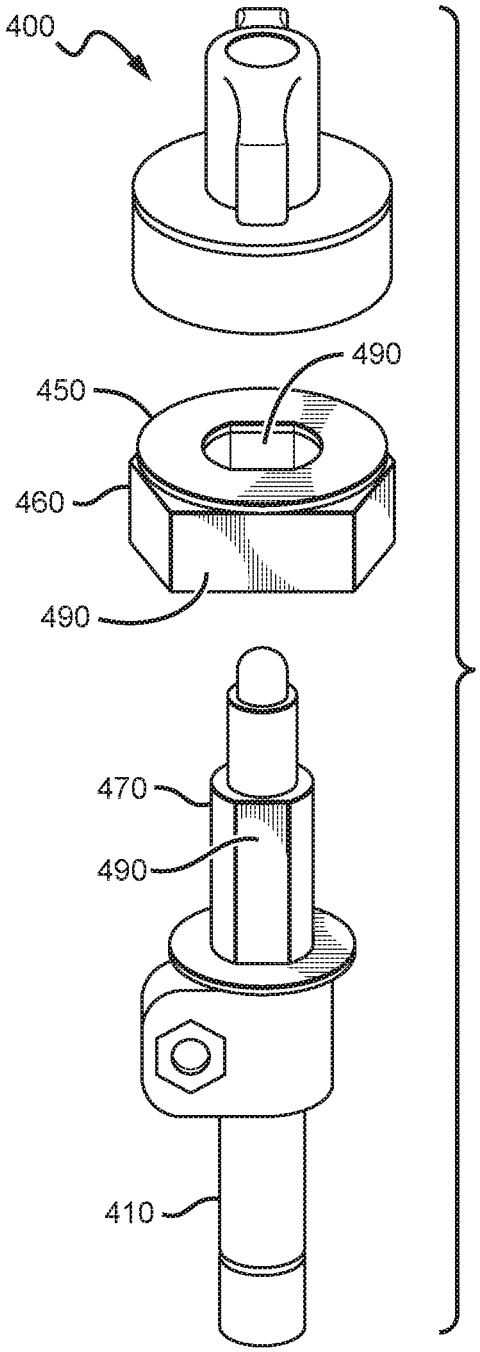

FIGS. 4A and 4B show a perspective view of a portion of an assembly 400 according to the present disclosure. FIGS. 4A and 4B show a stand 410, cymbal carrier 470 with a portion 470*a*, washer 450, and stopper 460 according to the present disclosure. The cymbal carrier 470 can be a separate element as shown, or a cymbal stand can include a cymbal carrier. The elements of the assembly 400 can include non-circular, non-curved, or flat portions 490, which can in combination with one another prevent the unintentional rotation of a cover such as the cover 300. The cymbal carrier 470, washer 450, stopper 460, frame (not shown), and/or cover (not shown) can include flat edges, which in some embodiments can mate with one another so as to prevent unintended rotation. The elements shown in FIGS. 4A and 4B can be the same as or similar to those shown in FIGS. 3A and 3B, previously described.

Figure 5A:
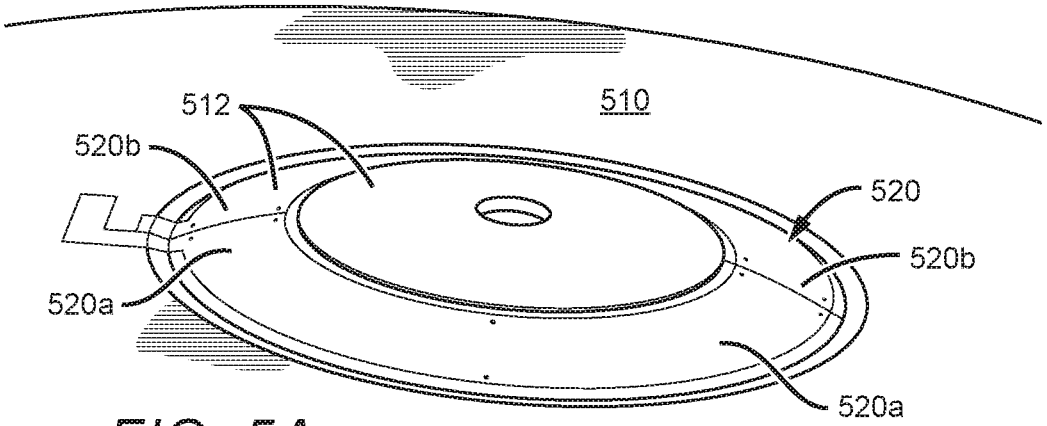
FIGS. 5A and 5B show top perspective and cross-sectional views of portions of a cymbal assembly according to one embodiment of the present disclosure.
Figure 5B:
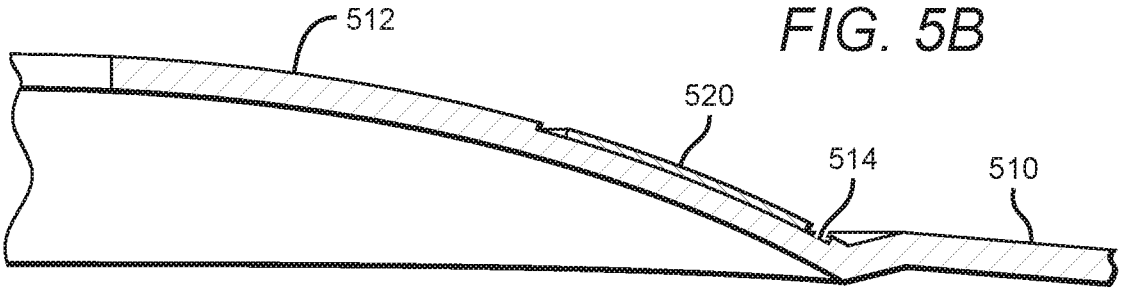

FIGS. 5A and 5B show one embodiment of a frame 510 according to the present disclosure. The frame 510 includes a bell portion 512. The inclusion of a bell portion (such as the bell portion 512) in an electronic cymbal frame (such as the frame 510) can be beneficial in that it provides the user an experience and feel more similar to a traditional acoustic cymbal and can provide for better actuation detection. In the specific embodiment shown, a sensor 520 is attached and/or mounted on the bell portion 512 of the frame 510.

As opposed to a planar sensor sheet such as the planar sensor sheets 8, 58 shown in FIGS. 1 and 2, the sensor 520 is non-planar. The sensor 520 can be annular and shaped to fit the shape of the bell portion 512, and thus rise from its outer edge to its inner edge. As best seen in FIG. 5B, the sensor 520 can be curved, such a slightly curved, as it rises from its outer edge to its inner edge. In other embodiments, the sensor 520 can be flat and angled as it rises from its outer edge to its inner edge, so as to be frustoconical or substantially frustoconical. The bell portion 512 can have the same or different shape than the sensor 520. In some embodiments, both the bell portion 512 and sensor 520 are curved as they rise; in other embodiments, both the bell portion 512 and sensor 520 are flat and angled as they rise so as to be frustoconical or substantially frustoconical, at least in the portion of the bell portion 512 underneath the sensor 520. Combinations and other embodiments are also possible.

Due to the geometry of a traditional cymbal bell, it can be very difficult to produce a single continuous and integral sensor that will adequately cover the bell portion of the frame so as to adequately receive signals from a user striking the cover's bell. As such, the sensor 520 can in certain embodiments include two separate/distinct portions 520*a*, 520*b* which can each include a first edge and a second edge. The sensor portions 520*a*, 520*b* can have edges that overlap, abut, or are proximate (but not in contact with) one another. Every combination of overlapping (e.g., the edges of both sensor portions 520*a*, 520*b* overlap), abutting (e.g., the edges of both sensor portions 520*a*, 520*b* abut one another), and proximate (e.g., the edges of both sensor portions 520*a*, 520*b* are proximate, but not in contact with, one another) are possible. The sensor portions 520*a*, 520*b* can each approximately cover 180°, or can each be over 180° and/or overlap. In another embodiment both of the sensor portions 520*a*, 520*b* are less than 180°. In some embodiments the sensor portions 520*a*, 520*b* are approximately equal annular lengths; in other embodiments, one portion may be larger than the other, such as one portion being 180° or more and the other portion being under 180°. The sensor portions 520*a*, 520*b* can collectively be over 180°; be 270° or over; be 300° or over; be 330° or over; be 350° or over; and/or be 360°. It is understood that embodiments with more than two separate/distinct portions are possible, and in certain embodiments those portions may combine in the same or similar manner as the portions 520*a*, 520*b*.

The frame 510, such as the bell portion 512, can include a cutout and/or shaped portion 514 for accommodating the sensor 520. Parts of the system, such as the cutout 514 and sensor 520, can be designed such that the top of the sensor 520 is at approximately the same height and/or along the same curve as the remainder of the bell portion 512. The cutout 514 and the sensor 520 can have approximately the same depth so as to produce a substantially flush surface; the cutout 514 can have a larger depth than the sensor 520 such that the sensor 520 does not protrude above the cutout 514; or the cutout 514 can have a smaller depth than the sensor 520.

Figure 6A:
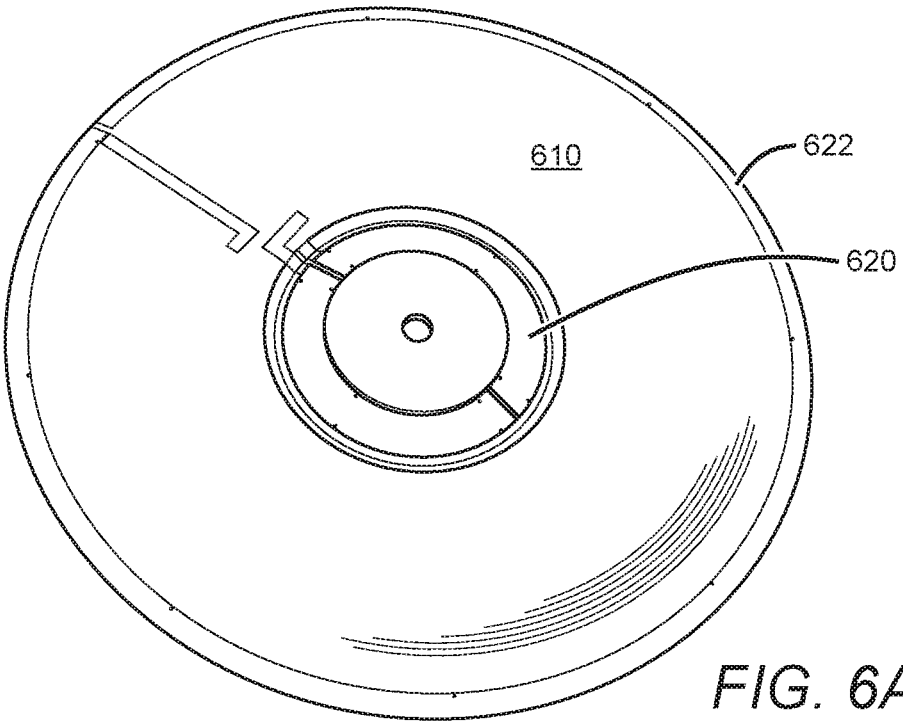
FIGS. 6A and 6B show top perspective and magnified top perspective views of portions of a cymbal assembly according to one embodiment of the present disclosure.
Figure 6B:
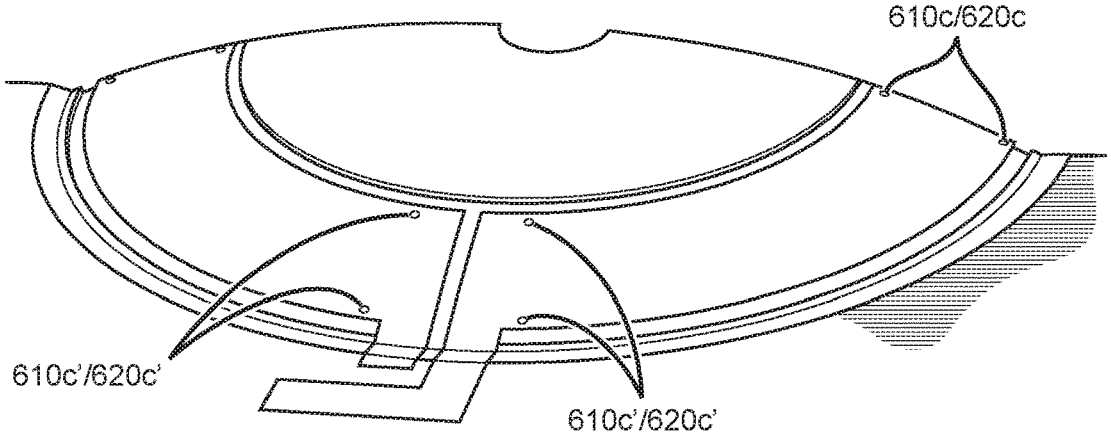

Sensors such as the sensor 520 according to the present disclosure are not limited to the bell area. Many prior art assemblies include planar sensor sheets around the edge of a frame underneath a cover. FIGS. 6A and 6B show one embodiment of the present disclosure showing an edge sensor 622. The sensor 622 can be around the edge of a frame such as the frame 610, which can be the same as or similar to the frame 510 and other frames previously described. A sensor around the bell such as the sensor 620 can also be included. The sensor 620 can include portions and arrangements as described above with regard to the sensor 520 (e.g., portions with edges overlapping, abutting, proximate, etc. one another) and other sensors described both herein and as understood by one of skill in the art. Both bell sensors and edge sensors, such as the bell sensor 620 and the edge sensor 622, can rise from their outer edge to the inner edge, with the bell sensor 620 rising at a steeper angle than the edge sensor 622 in most embodiments. The sensor 622 can be curved, or can be flat and angled so as to be frustoconical or substantially frustoconical, as described with regard to the sensor 520. Additionally, the sensor 622 can include two portions similar to those described with regard to the sensor 520. The sensor portions can have edges that overlap, abut, or are proximate (but not in contact with) one another. Every combination of overlapping (e.g., the edges of both sensor portions overlap), abutting (e.g., the edges of both sensor portions abut one another), and proximate (e.g., the edges of both sensor portions are proximate, but not in contact with, one another) are possible. The sensor portions can each approximately cover 180°, or can each be over 180° and/or overlap. In another embodiment both of the sensor portions can be less than 180°. In some embodiments the sensor portions are approximately equal annular lengths; in other embodiments, one portion may be larger than the other, such as one portion being 180° or more and the other portion being under 180°. The sensor portions 520*a*, 520*b* can collectively be over 180°; be 270° or over; be 300° or over; be 330° or over; be 350° or over; and/or be 360°. The frame 510 can also include a cutout and/or shaped portion similar to the portion 514 for accommodating the sensor 622.

Embodiments of the present disclosure can also include portions/components/devices to aid in the application of sensors. While planar sheet sensors such as those previously described and known in the art can be applied and/or placed relatively simply, application of non-planar sensors such as those previously described can be more challenging. As such, knobs or protrusions can be included in the underlying portion and the sensor can include holes; the sensor may include knobs and the underlying portion include holes; or, a combination of the two. Many different embodiments are possible. FIGS. 6A and 6B show one embodiment of a combination of a knob 610*c* and hole 620*c*, which can be placed at various points. In some embodiments, as shown with 610*c*'/620*c*', combinations can be at the same annular position but at different height locations of the sensor, such as being at or near the top and bottom, respectively. Many different embodiments are possible.

Certain prior electronic instruments, for various reasons, can require more force upon actuation to produce sound than would otherwise be necessary. Embodiments of the present disclosure recognize that reducing the contact area between the striking surface (such as a previously described cover)

and/or the striking surface's underside, and the sensor (such as the previously described sensors), can increase sensitivity and, thus, be more desirable for a musician. Reducing the contact area increases the amount of pressure on the sensor at any point due to the force of the strike being spread among a smaller area. Sensors according to the present disclosure can be primarily designed to detect an actuation based on pressure placed on the sensor. As such, reduction of contact area can result in the sensor sensing a higher level of a measurable characteristic than if the sensor and cover thereon included matching surfaces (e.g., were flat/smooth upon one another), thus making the system more sensitive to actuation. However, simply making the sensor smaller would result in less coverage such that certain actuations may not be detected at all.

Figure 7A:
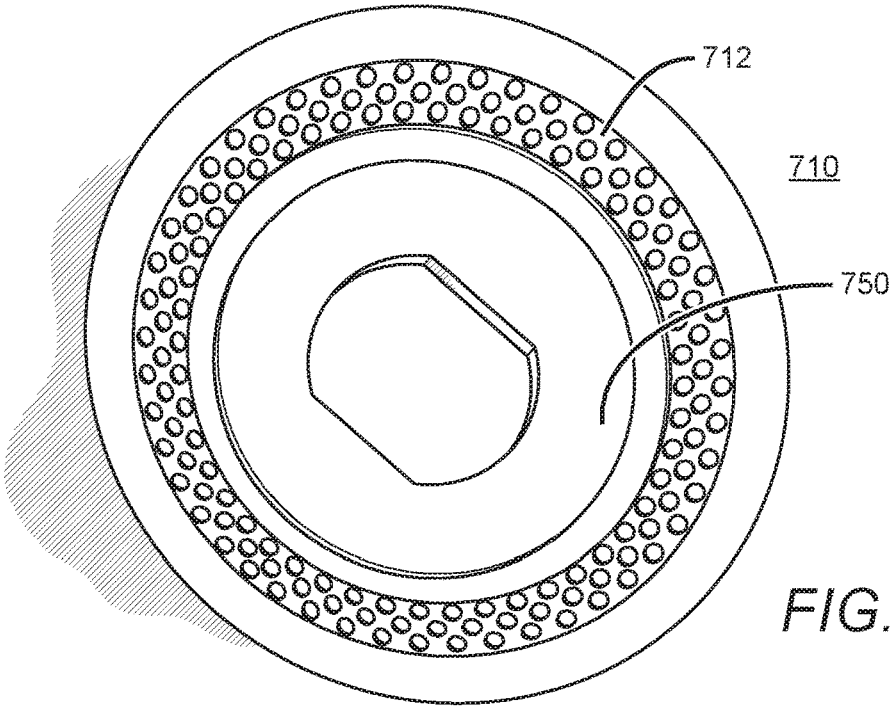
FIGS. 7A and 7B show bottom perspective and cross-sectional side perspective views of portions of a cover according to one embodiment of the present disclosure.
Figure 7B:
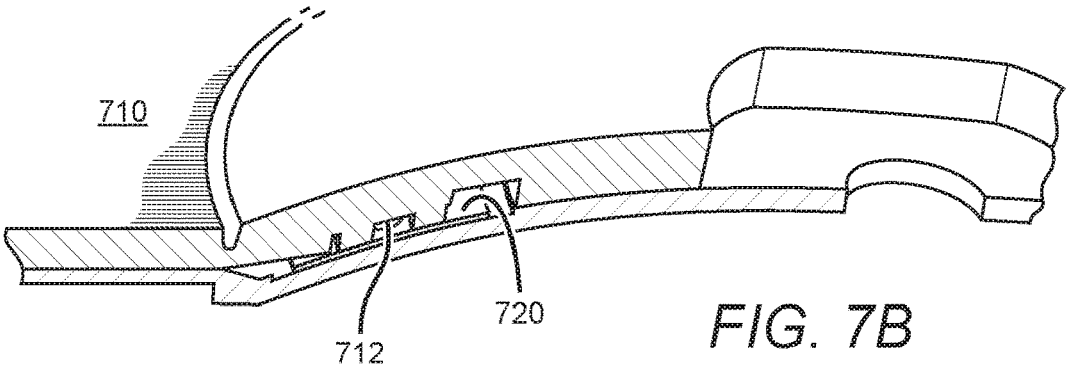

FIGS. 7A and 7B show the underside of a cover 710 according to the present disclosure. The cover 710 includes a non-smooth, non-flat, textured, bumped, and/or rough surface 712. The surface 712 can abut a sensor 720. By including the non-smooth surface 712, the total coverage the coverage area of the sensor 720 can be relatively large while the actual contact area between the surface 712 and sensor 720 is reduced and/or smaller than the total coverage area, since only the raised portions contact of the surface 712 are in contact with the sensor 720. Cover/sensor combinations according to the present disclosure can include coverage area to contact area ratios of, for example, 10:9 or larger, 5:4 or larger, 3:2 or larger, 2:1 or larger, 5:1 or larger, or even larger. It is understood that these ranges are only exemplary, and embodiments outside these ranges are possible. Further, while FIGS. 7A and 7B show a surface 712 as part of an underside of a bell cover, it is understood that the same concept can be applied to other areas, such as edges of a cover and edge sensors. Further, while the specific embodiment shown shows a cover with a non-smooth surface, it is understood that the sensor may also include a smooth surface in addition to or in place of the non-smooth surface. Additionally, the underside of the cover 710 can include a downward protruding portion 750 approximately in its center and/or around the aperture therethrough, which can assist in stabilizing the connection between the cover 710 and a cymbal stand or carrier.

While FIGS. 7A and 7B show a surface 712 including bump-like structures, other structures are also possible. For example, FIG. 8 shows one embodiment of a cover underside including a surface 812 having bars. Many different embodiments are possible.

FIG. 9 shows one possible mating configuration between a cover 900, frame 910, and sensor 920 (in this case, an edge sensor). As shown, the cover 900 can wrap around the outer surfaces of the inner frame 910. The cover 900 and frame 910 can include interlocking male/female connections as shown. In the specific embodiment shown, the underside of the cover 900 includes a non-smooth surface 912 corresponding to the edge sensor 920. For instance, the non-smooth surface 912 can include bars similar to or the same as the surface 812 described above with regard to FIG. 8. Many different embodiments are possible.

Although the present disclosure has been described in detail with reference to certain preferred configurations thereof, other versions are possible. Compatible elements from different embodiments can be combined with one another. For instance, one or more of covers with noncircular cutouts, nonplanar sensors, non-smooth surfaces for increased sensitivity, and protrusion/hole pairings for sensor placement can be combined in single embodiments. Therefore, the spirit and scope of the disclosure should not be limited to the versions described above.

I claim:

1. An electronic cymbal assembly comprising:

a cover, said cover including a noncircular cutout, wherein said noncircular cutout includes at least two flat edges; and a stopper abutting said cover, wherein said stopper comprises two flat edges abutting said two flat edges of said noncircular cutout.

2. The electronic cymbal assembly of claim 1, further comprising a cymbal carrier;

wherein said stopper is shaped to define a stopper cutout including at least two flat edges;

wherein said cymbal carrier comprises at least a portion protruding through said stopper cutout;

wherein said portion of said cymbal carrier comprises two flat edges abutting said stopper cutout flat edges.

3. The electronic cymbal assembly of claim 2, further comprising a washer on said stopper, said washer shaped to define a washer cutout including at least two flat edges, said washer cutout flat edges abutting said cymbal carrier flat edges.

4. An electronic cymbal assembly, comprising:

a frame shaped to define a bell;

a non-planar sensor on said bell, said sensor comprising a first sensor portion on said bell and a second sensor portion on said bell, said first sensor portion distinct from said second sensor portion;

wherein said sensor defines a substantially annular shape.

5. The electronic cymbal assembly of claim 4, wherein said first sensor portion comprises a first sensor portion first edge overlapping a second sensor portion first edge.

6. The electronic cymbal assembly of claim 4, wherein said first sensor portion comprises a first sensor portion first edge abutting a second sensor portion first edge.

7. The electronic cymbal assembly of claim 4, wherein said first sensor portion comprises a first sensor portion first edge proximate, but not contacting, a second sensor portion first edge.

8. The electronic cymbal assembly of claim 7, wherein said first sensor portion comprises a first sensor portion second edge proximate, but not contacting, a second sensor portion second edge.

9. The electronic cymbal assembly of claim 4, wherein said sensor is 270° or more around and is less than 360° around.

10. The electronic cymbal assembly of claim 4, wherein said sensor is 330° or more around and is less than 360° around.

11. The electronic cymbal assembly of claim 4, further comprising a non-planar edge sensor on an edge of said frame, said edge sensor comprising a first edge sensor portion and a second edge sensor portion, said first edge sensor portion distinct from said second edge sensor portion.

12. The electronic cymbal assembly of claim 4, wherein said sensor comprises an outer edge and an inner edge, and wherein said sensor is curved as it rises from said outer edge to said inner edge.

13. The electronic cymbal assembly of claim 4, wherein said sensor comprises an outer edge and an inner edge, and wherein said sensor is flat as it rises from said outer edge to said inner edge so as to be substantially frustoconical.

14. The electronic cymbal assembly of claim 4, wherein said sensor is 180° or more around and is less than 360° around.

15. The electronic cymbal assembly of claim 4, wherein said frame comprises protrusions and said sensor is shaped to define holes mating with said protrusions.

16. The electronic cymbal assembly of claim 4, wherein said sensor comprises a third sensor portion on said bell.

17. The electronic cymbal assembly of claim 1, wherein said stopper is rigid.

18. The electronic cymbal assembly of claim 1, wherein said stopper is pliable.

19. The electronic cymbal assembly of claim 1, wherein said stopper is foam.

20. The electronic cymbal assembly of claim 1, wherein said two flat edges of said noncircular cutout are part of a regular polygon shape.

21. The electronic cymbal assembly of claim 1, wherein said two flat edges of said noncircular cutout are part of an irregular polygon shape.

22. The electronic cymbal assembly of claim 1, wherein said two flat edges of said noncircular cutout are part of a star shape.

23. The electronic cymbal assembly of claim 1, wherein said noncircular cutout further includes at least a third flat edge, and said stopper comprises a third flat edge abutting said third flat edge of said noncircular cutout.

24. The electronic cymbal assembly of claim 1, wherein said noncircular cutout and said stopper are substantially the same shape.

25. The electronic cymbal assembly of claim 1, wherein said noncircular cutout further includes at least one curved edge.

26. An electronic cymbal assembly, comprising:

a frame shaped to define a bell;

a non-planar sensor on said bell, said sensor defining a substantially annular shape and rising from an outer edge of said sensor to an inner edge of said sensor;

wherein said sensor is 180° or more around and is less than 360° around.

27. The electronic cymbal assembly of claim 26, wherein said sensor further comprises at least a first edge and a second edge, said first edge proximate, but not contacting, said second edge.

28. The electronic cymbal assembly of claim 26, wherein said sensor is 270° or more around and is less than 360° around.

* * * * *